US009340031B2

(12) United States Patent
Sugitani et al.

(10) Patent No.: US 9,340,031 B2
(45) Date of Patent: May 17, 2016

(54) INK CIRCULATION TYPE INKJET PRINTER

(71) Applicant: RISO KAGAKU CORPORATION, Tokyo (JP)

(72) Inventors: Hiroshi Sugitani, Ibaraki (JP); Tomoyuki Akiyama, Ibaraki (JP); Akira Nishiyama, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 14/849,883

(22) Filed: Sep. 10, 2015

(65) Prior Publication Data

US 2016/0075144 A1 Mar. 17, 2016

(30) Foreign Application Priority Data

Sep. 16, 2014 (JP) ..... 2014-187738

(51) Int. Cl.
*B41J 29/38* (2006.01)
*B41J 2/175* (2006.01)
*B41J 2/18* (2006.01)

(52) U.S. Cl.
CPC ..... *B41J 2/17596* (2013.01); *B41J 2/17556* (2013.01); *B41J 2/175* (2013.01); *B41J 2/18* (2013.01)

(58) Field of Classification Search
CPC ..... B41J 2/17596; B41J 2/17556; B41J 2/18; B41J 2/175; B41J 2/185; B41J 2/17513
USPC ..... 347/6, 89, 90, 85, 84
See application file for complete search history.

(56) References Cited

U.S. PATENT DOCUMENTS 7,845,784 B2 12/2010 Nitta et al.
2009/0295881 A1* 12/2009 Tasaka ..... B41J 2/1707 347/85
2012/0188314 A1* 7/2012 Akiyama ..... B41J 2/175 347/85

FOREIGN PATENT DOCUMENTS

JP 2008-162262 7/2008

* cited by examiner

*Primary Examiner* — Henok Legesse
(74) *Attorney, Agent, or Firm* — Greenblum & Bernstein, P.L.C

(57) ABSTRACT

A controller, upon a pressure of one tank of a positive pressure tank and a negative pressure tank reaching a setting pressure of the one tank prior to a pressure of the other tank reaching a setting pressure of the other tank after driving an air pump, sets an air opening valve opening time at each unit time according to a difference between the pressure of the one tank and the pressure of the other tank, and repeatedly drives one of a positive-pressure-side air opening valve and a negative-pressure-side air opening valve corresponding to the one tank to switch to and hold an air open state of the one tank for the set air opening valve opening time within the unit time, until the pressure of the other tank reaches the setting pressure of the other tank.

3 Claims, 6 Drawing Sheets

FIG. 7

| | | NEGATIVE PRESSURE TANK LIQUID LEVEL SENSOR | |
|---|---|---|---|
| | | ON | OFF |
| POSITIVE PRESSURE TANK LIQUID LEVEL SENSOR | ON | INK PUMP: OFF<br>INK SUPPLY VALVE: CLOSED | INK PUMP: OFF<br>INK SUPPLY VALVE: CLOSED |
| | OFF | INK PUMP: ON<br>INK SUPPLY VALVE: CLOSED | INK PUMP: OFF<br>INK SUPPLY VALVE: OPENED |

INK CIRCULATION TYPE INKJET PRINTER

CROSS REFERENCE TO RELATED APPLICATION

This application is based upon and claims the benefit of priority from the prior Japanese Patent Application No. 2014-187738, filed on Sep. 16, 2014, the entire contents of which are incorporated herein by reference.

BACKGROUND

1. Technical Field

The disclosure relates to an ink circulation type inkjet printer.

2. Related Art

Japanese Unexamined Patent Application Publication No. 2008-162262 describes an ink circulation type inkjet printer that performs printing by ejecting ink through a nozzle of an inkjet head while circulating the ink.

In some ink circulation type inkjet printers, a positive pressure tank is disposed upstream of an inkjet head, a negative pressure tank is disposed downstream of the inkjet head, the positive pressure tank is disposed at a position higher than the inkjet head, and the negative pressure tank is connected to an air pump for generating a negative pressure.

Such an inkjet printer circulates ink and generates a negative pressure appropriate for ejection of ink in a nozzle, by using a hydraulic head pressure (positive pressure) caused by the difference in height between the positive pressure tank and the inkjet head, and by using a negative pressure generated in the negative pressure tank by the air pump.

In an inkjet head in which nozzles are disposed in a high density to achieve printing in a high resolution, a flow path of ink is narrow, and accordingly a flow path resistance is high. When such an inkjet head is used in an inkjet head printer in the above-described configuration, the difference in height between the positive pressure tank and the inkjet head has to be large in order to obtain a needed circulation flow rate. This may result in an increase in the size of the printer.

If an air pump generates a pressure (positive pressure) also in the positive pressure tank, a needed pressure may be generated regardless of the difference in height between the positive pressure tank and the inkjet head. However, the provision of separate air pumps to the positive and negative pressure tanks causes the size and cost of the printer to increase.

To address this issue, there is provided a printer in which a single air pump sucks air from the negative pressure tank and delivers air to the positive pressure tank, thereby generating a positive pressure in the positive pressure tank as well as a negative pressure in the negative pressure tank.

SUMMARY

In an inkjet printer in which the above-described single air pump generates pressures in the positive pressure tank and the negative pressure tank, the air pump is activated when ink circulation is started, and the air pump is stopped when setting pressures are generated in the positive pressure tank and the negative pressure tank.

In this case, since the single air pump sucks air from the negative pressure tank and delivers air to the positive pressure tank, the pressures generated in both tanks depend on the air capacities of a positive-pressure-side air system and a negative-pressure-side air system. Here, the positive-pressure-side air system includes the positive pressure tank and a portion (such as a pipe) that communicates with the positive pressure tank. The negative-pressure-side air system includes the negative pressure tank and a portion (such as a pipe) that communicates with the negative pressure tank. For instance, when the positive-pressure-side air system and the negative-pressure-side air system have an equal air capacity, the positive pressure generated in the positive pressure tank and the negative pressure generated in the negative pressure tank due to driving of the air pump are equal in absolute value.

Therefore, in order to generate the setting pressures in the positive pressure tank and the negative pressure tank, the positive-pressure-side air system and the negative-pressure-side air system need be designed to have air capacities corresponding to the respective setting pressures. This consequently reduces flexibility of design of the air systems.

The present disclosure aims to provide an ink circulation type inkjet printer that is capable of generating setting pressures in a positive pressure tank and a negative pressure tank by a single air pump while avoiding reduction in flexibility of design of air systems.

An inkjet printer in accordance with some embodiments includes: an inkjet head with a nozzle for ejecting ink; a positive pressure tank configured to store the ink to be supplied to the inkjet head; a positive-pressure-side air opening valve configured to switch between a sealed state and an air open state of the positive pressure tank; a negative pressure tank configured to receive the ink not consumed by the inkjet head; a negative-pressure-side air opening valve configured to switch between a sealed state and an air open state of the negative pressure tank; a circulation path for circulating the ink among the positive pressure tank, the inkjet head, and the negative pressure tank; an air pump configured to suck air from the negative pressure tank and to deliver air to the positive pressure tank; and a controller configured to drive the positive-pressure-side air opening valve and the negative-pressure-side air opening valve to switch to and hold the sealed states of the positive pressure tank and the negative pressure tank and then drive the air pump to generate setting pressures in the positive pressure tank and the negative pressure tank, upon starting circulation of the ink in the circulation path. The controller is configured to: upon a pressure of one tank of the positive pressure tank and the negative pressure tank reaching the setting pressure of the one tank prior to a pressure of the other tank of the positive pressure tank and the negative pressure tank reaching the setting pressure of the other tank after driving the air pump, set an air opening valve opening time at each unit time according to a difference between the pressure of the one tank and the pressure of the other tank; and repeatedly drive one of the positive-pressure-side air opening valve and the negative-pressure-side air opening valve corresponding to the one tank to switch to and hold the air open state of the one tank for the set air opening valve opening time within the unit time, until the pressure of the other tank reaches the setting pressure of the other tank.

With the configuration described above, the control of opening and closing of the positive-pressure-side air opening valve and the negative-pressure-side air opening valve (the control of switching between the sealed state and the air open state of the positive and negative pressure tanks) allows the pressure of the one tank to be maintained at the corresponding setting pressure when the pressure of the other tank reaches the corresponding setting pressure. Thus, the positive-pressure-side air system and the negative-pressure-side air system do not have to be designed to have air capacities corresponding to the respective setting pressures. Therefore, it is possible to generate setting pressures in a positive pressure tank and a negative pressure tank by a single air pump while avoiding reduction in flexibility of design of air systems.

BRIEF DESCRIPTION OF DRAWINGS

FIG. 7 is an explanatory table of liquid level maintaining control.

DETAILED DESCRIPTION

Figure 1:
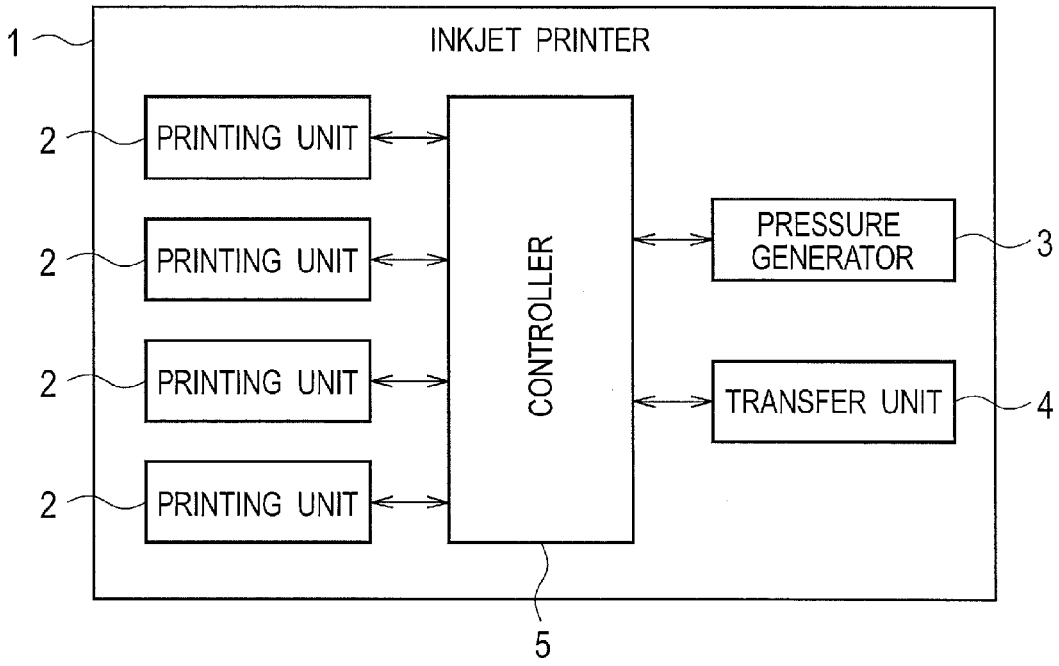
FIG. 1 is a block diagram illustrating a configuration of an inkjet printer according to an embodiment.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Description will be hereinbelow provided for an embodiment of the present invention by referring to the drawings. It should be noted that the same or similar parts and components throughout the drawings will be denoted by the same or similar reference signs, and that descriptions for such parts and components will be omitted or simplified. In addition, it should be noted that the drawings are schematic and therefore different from the actual ones.

Figure 2:
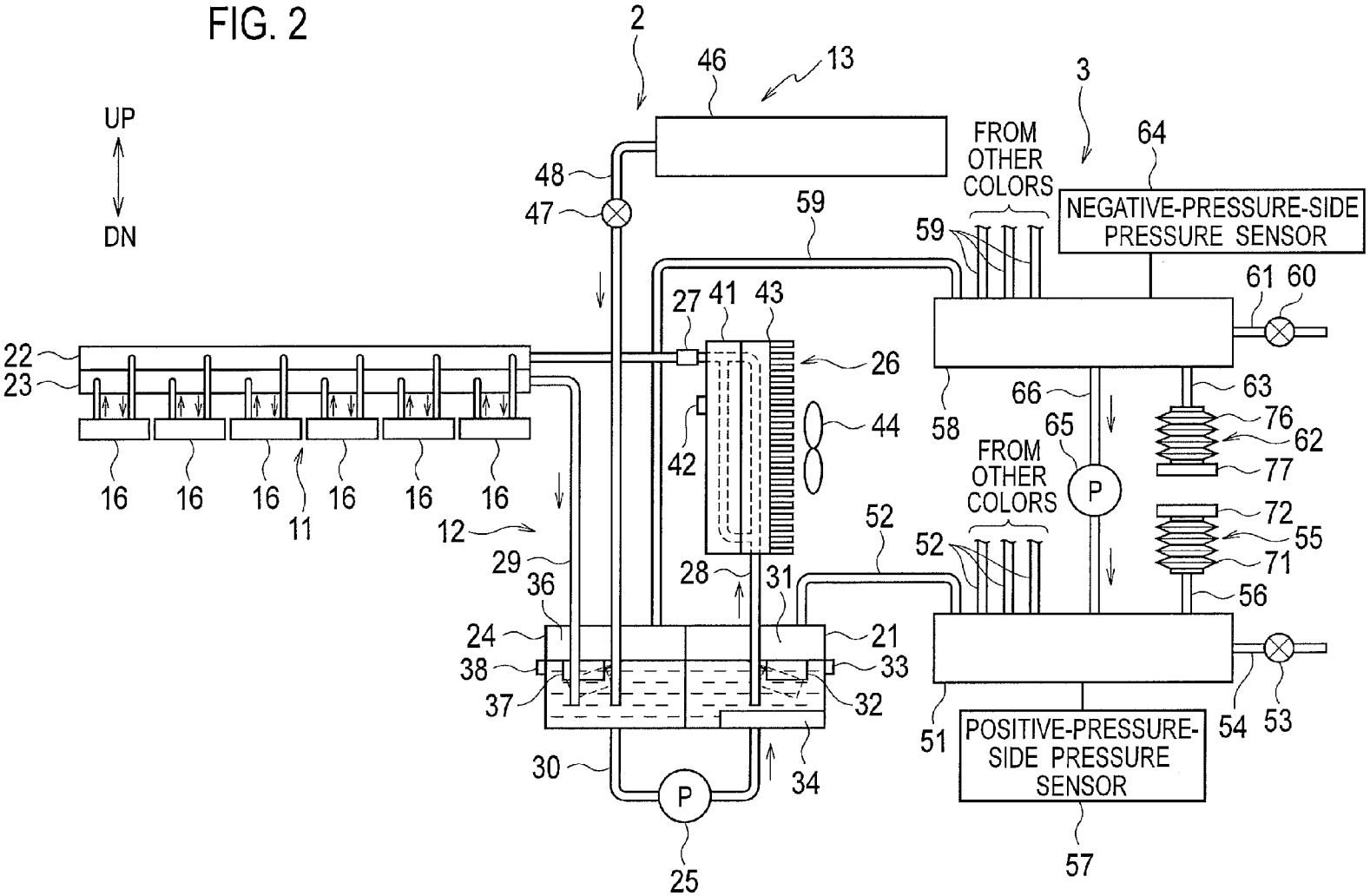
FIG. 2 is a schematic configuration diagram of printing units and a pressure applying unit of the inkjet printer illustrated in FIG. 1.

FIG. 1 is a block diagram illustrating the configuration of an inkjet printer according to an embodiment of the present disclosure. FIG. 2 is a schematic configuration diagram of printing units and a pressure generator of the inkjet printer illustrated in FIG. 1. It is to be noted that the upward and downward directions in the following description indicate the vertical direction, and UP indicates the upward direction and DN indicates the downward direction in FIG. 2.

As illustrated in FIG. 1, an inkjet printer 1 according to the present embodiment includes four printing units 2, a pressure generator 3, a transfer unit 4, and a controller 5.

Each of the printing units 2 ejects ink onto a sheet of paper to print an image while circulating ink, the sheet of paper being transferred by the transfer unit 4. The four printing units 2 eject ink of different colors (for instance, black, cyan, magenta, yellow). The four printing units 2 have the same configuration except that the colors of ink to be ejected are different.

As illustrated in FIG. 2, each of the printing units 2 includes an inkjet head 11, an ink circulation unit 12 and an ink supply unit 13.

The inkjet head 11 ejects ink which is supplied by the ink circulation unit 12. The inkjet head 11 includes plural head modules 16.

Each of the head modules 16 has an ink chamber (not illustrated) that stores ink and plural nozzles (not illustrated) that eject ink. A piezo element (not illustrated) is disposed in the ink chamber. Ink is ejected through the nozzles by driving of the piezo element.

The ink circulation unit 12 supplies ink to the inkjet head 11 while circulating ink. The ink circulation unit 12 includes a positive pressure tank 21, an ink distributor 22, an ink collector 23, a negative pressure tank 24, an ink pump 25, an ink temperature regulator 26, an ink temperature sensor 27, and ink circulation pipes 28 to 30.

The positive pressure tank 21 stores ink to be supplied to the inkjet head 11. The ink in the positive pressure tank 21 is supplied to the inkjet head 11 via the ink circulation pipe 28 and the ink distributor 22. An air layer 31 is formed on the liquid level of the ink in the positive pressure tank 21. The positive pressure tank 21 communicates with the later-described positive pressure common air chamber 51 via the later-described positive-pressure-side communication pipes 52. The positive pressure tank 21 is disposed at a position lower than (under) the inkjet head 11.

The positive pressure tank 21 is provided with a float member 32, a positive pressure tank liquid level sensor 33, and an ink filter 34.

One end of the float member 32 is pivotally supported by a support axle (not illustrated) in the positive pressure tank 21 so that the float member 32 rotates according to the liquid level height of the ink in the positive pressure tank 21 until the liquid level height reaches a reference height. The other end of the float member 32 is provided with a magnet (not illustrated).

The positive pressure tank liquid level sensor 33 is for determining whether or not the liquid level height of the ink in the positive pressure tank 21 has reached a reference height. The reference height is lower than the upper end of the positive pressure tank 21. The positive pressure tank liquid level sensor 33 includes a magnetic sensor and detects the magnet of the float member 32 when the liquid level height has reached the reference height. When the magnet of the float member 32 is detected, that is, when the liquid level height in the positive pressure tank 21 is greater than or equal to the reference height, the positive pressure tank liquid level sensor 33 outputs a signal that indicates "ON". When the magnet of the float member 32 is not detected, that is, when the liquid level height in the positive pressure tank 21 is less than the reference height, the positive pressure tank liquid level sensor 33 outputs a signal that indicates "OFF".

The ink filter 34 removes dirt and other in the ink.

The ink distributor 22 distributes the ink supplied from the pressure tank 21 to each head module 16 of the inkjet head 11 through the ink circulation pipe 28.

The ink collector 23 collects from each head module 16 the ink that has not been consumed by the inkjet head 11. The ink collected by the ink collector 23 flows to the negative pressure tank 24 through the ink circulation pipe 29.

The negative pressure tank 24 receives from the ink collector 23 and stores the ink that has not been consumed by the inkjet head 11. In addition, the negative pressure tank 24 stores the ink that is supplied from an ink cartridge 46 of the later-described ink supply unit 13. An air layer 36 is formed on the liquid level of the ink in the negative pressure tank 24. The negative pressure tank 24 communicates with the later-described negative pressure common air chamber 58 through the later-described negative-pressure-side communication pipe 59. The negative pressure tank 24 is disposed at the same height as the positive pressure tank 21.

The negative pressure tank 24 is provided with a float member 37 and a negative pressure tank liquid level sensor 38.

The float member 37 and the negative pressure tank liquid level sensor 38 are similar to the float member 32 and the positive pressure tank liquid level sensor 33 of the positive pressure tank 21. When the magnet of the float member 37 is detected, that is, when the liquid level height in the negative pressure tank 24 is greater than or equal to the reference height, the negative pressure tank liquid level sensor 38 outputs a signal that indicates "ON". When the magnet of the float member 37 is not detected, that is, when the liquid level height in the negative pressure tank 24 is less than the reference height, the negative pressure tank liquid level sensor 38 outputs a signal that indicates "OFF". The reference height is lower than the upper end of the negative pressure tank 24.

The ink pump 25 delivers ink from the negative pressure tank 24 to the positive pressure tank 21. The ink pump 25 is provided midway along the ink circulation pipe 30.

The ink temperature regulator 26 regulates the temperature of the ink in the ink circulation unit 12. The ink temperature regulator 26 is provided midway along the ink circulation pipe 28. The ink temperature regulator 26 includes a heater 41, a heater temperature sensor 42, a heat sink 43, and a cooling fan 44.

The heater 41 heats the ink in the ink circulation pipe 28. The heater temperature sensor 42 detects the temperature of the heater 41. The heat sink 43 cools the ink in the ink circulation pipe 28 by heat radiation. The cooling fan 44 delivers cooling air to the heat sink 43.

The ink temperature sensor 27 detects the temperature of the ink in the ink circulation unit 12. The ink temperature sensor 27 is provided midway along the ink circulation pipe 28.

The ink circulation pipe 28 connects the positive pressure tank 21 and the ink distributor 22. Part of the ink circulation pipe 28 is branched into a portion that passes through the heater 41 and a portion that passes through the heat sink 43. In the ink circulation pipe 28, ink flows from the positive pressure tank 21 to the ink distributor 22. The ink circulation pipe 29 connects the ink collector 23 and the negative pressure tank 24. In the ink circulation pipe 29, ink flows from the ink collector 23 to the negative pressure tank 24. The ink circulation pipe 30 connects the negative pressure tank 24 and the positive pressure tank 21. In the ink circulation pipe 30, ink flows from the negative pressure tank 24 to the positive pressure tank 21. The ink circulation pipes 28 to 30, the ink distributor 22, and the ink collector 23 constitute a circulation path for circulating ink between the positive pressure tank 21, the inkjet head 11, and the negative pressure tank 24.

The ink supply unit 13 supplies ink to the ink circulation unit 12. The ink supply unit 13 includes an ink cartridge 46, an ink supply valve 47, and an ink supply pipe 48.

The ink cartridge 46 stores ink to be used in printing by the inkjet head 11. The ink in the ink cartridge 46 is supplied to the negative pressure tank 24 of the ink circulation unit 12 through the ink supply pipe 48.

The ink supply valve 47 opens and closes the flow path of ink in the ink supply pipe 48. When ink is supplied to the negative pressure tank 24, the ink supply valve 47 is opened.

The ink supply pipe 48 connects the ink cartridge 46 and the negative pressure tank 24. In the ink supply pipe 48, ink flows from the ink cartridge 46 to the negative pressure tank 24.

The pressure generator 3 generates pressure for ink circulation to the positive pressure tank 21 and the negative pressure tank 24 of each printing unit 2. The pressure generator 3 includes a positive pressure common air chamber 51, four positive-pressure-side communication pipes 52, a positive-pressure-side air opening valve 53, a positive-pressure-side air opening pipe 54, a positive-pressure-side pressure regulator 55, a positive-pressure-side pressure regulation pipe 56, a positive-pressure-side pressure sensor 57, a negative pressure common air chamber 58, four negative-pressure-side communication pipes 59, a negative-pressure-side air opening valve 60, a negative-pressure-side air opening pipe 61, a negative-pressure-side pressure regulator 62, a negative-pressure-side pressure regulation pipe 63, a negative-pressure-side pressure sensor 64, an air pump 65, and a pipe 66 for air pump.

The positive pressure common air chamber 51 is a chamber for equalizing the pressures of the positive pressure tanks 21 of the printing units 2. The positive pressure common air chamber 51 communicates with the air layers 31 of the positive pressure tanks 21 of the four printing units 2 through the four positive-pressure-side communication pipes 52. Thus, the pressure tanks 21 of the printing units 2 communicate with each other through the positive pressure common air chamber 51 and the positive-pressure-side communication pipes 52.

The positive-pressure-side communication pipes 52 allow the positive pressure common air chamber 51 and the air layer 31 of the positive pressure tank 21 to communicate with each other. Each printing unit 2 is provided with a corresponding one of the four positive-pressure-side communication pipes 52. Each positive-pressure-side communication pipe 52 has one end connected to the positive pressure common air chamber 51 and the other end connected to the air layer 31 of a corresponding positive pressure tank 21.

The positive-pressure-side air opening valve 53 opens and closes the flow path of the air in the positive-pressure-side air opening pipe 54 for switching between a sealed state and an air open state of the positive pressure tanks 21 of the printing units 2 through the positive pressure common air chamber 51. When the positive-pressure-side air opening valve 53 is closed, the positive pressure common air chamber 51 and the positive pressure tank 21 of each printing unit 2 assume a sealed state. When the positive-pressure-side air opening valve 53 is open, the positive pressure common air chamber 51 and the positive pressure tank 21 of each printing unit 2 assume an air open state. The positive-pressure-side air opening valve 53 is provided midway along the positive-pressure-side air opening pipe 54.

The positive-pressure-side air opening pipe 54 forms a flow path of air for opening the positive pressure common air chamber 51 and the positive pressure tank 21 of each printing unit 2 to the atmosphere. The positive-pressure-side air opening pipe 54 has one end connected to the positive pressure common air chamber and the other end connected to the atmosphere. The positive-pressure-side air opening pipe 54 is formed of a pipe having such a low flow path resistance that instantaneously after the positive-pressure-side air opening valve 53 is opened in a state where a positive pressure is applied to the positive pressure common air chamber 51 and the positive pressure tank 21, the pressure of the positive pressure common air chamber 51 and the positive pressure tank 21 can return to the atmospheric pressure.

During circulation of ink, the positive-pressure-side pressure regulator 55 regulates the pressure of the positive pressure tank 21 to maintain the pressure at the setting pressure Pk on positive pressure side. The positive-pressure-side pressure regulator 55 is disposed over the positive pressure common air chamber 51. The positive-pressure-side pressure regulator 55 includes a bellows 71 and a weight 72.

The bellows 71 absorbs a variation in the pressures of the positive pressure tank 21 and the positive pressure common air chamber 51, the variation in the pressures being caused by a liquid level variation in the positive pressure tank 21. The bellows 71 is expandable and contractable in a vertical direction and the volume of its internal space varies according to the expansion and contraction. The bellows 71 communicates with the positive pressure common air chamber 51 through the positive-pressure-side pressure regulation pipe 56.

The weight 72 applies a force to the bellows 71 in a contraction direction. The weight 72 is mounted on the upper end of the bellows 71. When the pressures (positive pressure) of the positive pressure tank 21, the positive pressure common air chamber 51, and the bellows 71 equal to the setting pressure Pk, upward force applied to the weight 72 from the bellows 71 and the gravity applied to the weight 72 are balanced. During standby in which ink is not circulated, the weight 72 is at a reference position.

The positive-pressure-side pressure regulation pipe 56 connects the positive pressure common air chamber 51 and the positive-pressure-side pressure regulator 55. The positive-pressure-side pressure regulation pipe 56 has one end connected to the upper surface of the positive pressure common air chamber 51 and the other end connected to the lower end of the bellows 71 of the positive-pressure-side pressure regulator 55.

The positive-pressure-side pressure sensor 57 detects the pressure in the positive pressure common air chamber 51. The pressure in the positive pressure common air chamber 51 is equal to the pressure in the positive pressure tank 21 of each printing unit 2. This is because the positive pressure common air chamber 51 communicates with the air layer 31 in the positive pressure tank 21 of each printing unit 2.

The negative pressure common air chamber 58 is an air chamber for equalizing the pressures of the negative pressure tanks 24 of the printing units 2. The negative pressure common air chamber 58 communicates with the air layers 36 of the negative pressure tanks 24 of the four printing units 2 through the respective four negative-pressure-side communication pipes 59. Thus, the negative pressure tanks 24 of the printing units 2 communicate with each other through the negative pressure common air chamber 58 and the negative-pressure-side communication pipes 59.

The negative-pressure-side communication pipes 59 allow the negative pressure common air chamber 58 and the air layer 36 of each negative pressure tank 24 to communicate with each other. Each printing unit 2 is provided with a corresponding one of the four negative-pressure-side communication pipes 59. Each negative-pressure-side communication pipes 59 has one end connected to the negative pressure common air chamber 58 and the other end connected to the air layer 36 of a corresponding negative pressure tank 24.

The negative-pressure-side air opening valve 60 opens and closes the flow path of the air in the negative-pressure-side air opening pipe 61 for switching between a sealed state and an air opened state of the negative pressure tank 24 of each printing unit 2 through the negative pressure common air chamber 58. When the negative-pressure-side air opening valve 60 is closed, the negative pressure common air chamber 58 and the negative pressure tank 24 of each printing unit 2 assume a sealed state. When the negative-pressure-side air opening valve 60 is open, the negative pressure common air chamber 58 and the negative pressure tank 24 of each printing unit 2 assume an air open state. The negative-pressure-side air opening valve 60 is provided midway along the negative-pressure-side air opening pipe 61.

The negative-pressure-side air opening pipe 61 forms a flow path of air for opening the negative pressure common air chamber 58 and the negative pressure tank 24 of each printing unit 2 to the atmosphere. The negative-pressure-side air opening pipe 61 has one end connected to the negative pressure common air chamber and the other end connected to the atmosphere. The negative-pressure-side air opening pipe 61 is formed of a pipe having such a low flow path resistance that instantaneously after the negative-pressure-side air opening valve 60 is opened in a state where a negative pressure is applied to the negative pressure common air chamber 58 and the negative pressure tank 24, the pressure of the negative pressure common air chamber 58 and the negative pressure tank 24 can return to the atmospheric pressure.

During circulation of ink, the negative-pressure-side pressure regulator 62 regulates the pressure of the negative pressure tank 24 to maintain the pressure at the setting pressure Pf on negative pressure side. The negative-pressure-side pressure regulator 62 is disposed under the negative pressure common air chamber 58. The negative-pressure-side pressure regulator 62 includes a bellows 76 and a weight 77.

The bellows 71 absorbs a variation in the pressures of the negative pressure tank 24 and the negative pressure common air chamber 58, the variation in the pressures being caused by a liquid level variation in the negative pressure tank 24. Similarly to the bellows 71 of the positive-pressure-side pressure regulator 55, the bellows 76 is expandable and contractable in a vertical direction and the volume of its internal space varies according to the expansion and contraction. The bellows 76 communicates with the negative pressure common air chamber 58 through the negative-pressure-side pressure regulation pipe 63.

The weight 77 applies a force to the bellows 76 in an extension direction. The weight 77 is mounted on the lower end of the bellows 76. When the pressures (negative pressure) of the negative pressure tank 24, the negative pressure common air chamber 58, and the bellows 76 equal to the setting pressure Pf, upward force applied to the weight 77 from the bellows 76 and the gravity applied to the weight 77 are balanced. During standby in which ink is not circulated, the weight 77 is at a reference position.

The negative-pressure-side pressure regulation pipe 63 connects the negative pressure common air chamber 58 and the negative-pressure-side pressure regulator 62. The negative-pressure-side pressure regulation pipe 63 has one end connected to the lower surface of the negative pressure common air chamber 58 and the other end connected to the upper end of the bellows 76 of the negative-pressure-side pressure regulator 62.

The negative-pressure-side pressure sensor 64 detects the pressure of the negative pressure common air chamber 58. The pressure of the negative pressure common air chamber 58 is equal to the pressure of the negative pressure tank 24 of each printing unit 2. This is because the negative pressure common air chamber 58 communicates with the air layer 36 of the negative pressure tank 24 of each printing unit 2.

The air pump 65 sucks air from the negative pressure tank 24 of each printing unit 2 through the negative pressure common air chamber 58 and delivers air to the positive pressure tank 21 of each printing unit 2 through the positive pressure common air chamber 51. The air pump 65 is provided midway along the pipe 66 for air pump.

The pipe 66 for air pump forms a flow path of air that is delivered from the negative pressure common air chamber 58 to the positive pressure common air chamber 51 by the air pump 65. The pipe 66 for air pump has one end connected to the negative pressure common air chamber 58 and the other end connected to the positive pressure common air chamber 51.

The transfer unit 4 takes a sheet of paper from a paper feed tray (not illustrated) and transfers the sheet along a transfer path (not illustrated). The transfer unit 4 has a roller for transferring a sheet of paper and a motor for driving the roller (both not illustrated).

The controller 5 controls the operation of each component of the inkjet printer 1. The controller 5 includes a storage unit such as a CPU, a RAM, a ROM, and a hard disk. The controller 5 achieves the control (function) described below by executing a desirable program that is stored in the storage unit to be used in the present device.

When ink circulation is started for performing printing, the controller 5 generates setting pressure Pk in the positive pressure tank 21 and setting pressure Pf in the negative pressure tank 24 by the later-described pressure generation processing. The setting pressures Pk, Pf are predetermined values that allow the nozzle pressure of the inkjet head 11 to stay in an appropriate range of negative pressure while maintaining circulation of the ink at a needed flow rate (quantity of flow) in the ink circulation unit 12. The setting pressure Pf on the negative pressure side is higher in absolute value than the setting pressure Pk on the positive pressure side.

Figure 3:
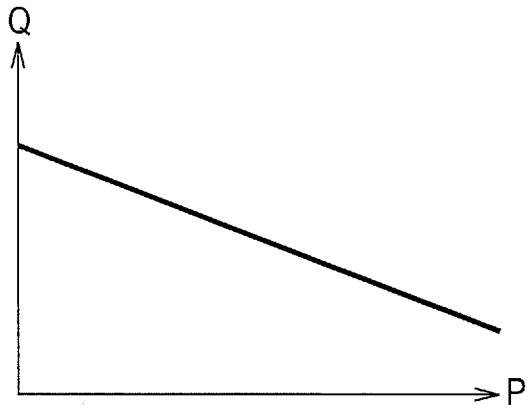
FIG. 3 is a graph illustrating PQ characteristic of an air pump.

The controller 5 stores PQ characteristic as a table or a function, the PQ characteristic indicating the relationship between load pressure P and air flow rate Q in the air pump 65, as illustrated in FIG. 3. The PQ characteristic of the air pump 65 is used in pressure generation processing.

Next, the operation of the inkjet printer 1 will be described.

When printing is performed, the controller 5 generates the respective setting pressures Pk and Pf in the positive pressure tank 21 and the negative pressure tank 24 in order to circulate ink in the ink circulation unit 12. First, the pressure generation processing for generating the setting pressure Pk, Pf will be described.

Here, it is assumed in the present embodiment that the air capacity of the positive-pressure-side air system and the air capacity of the negative-pressure-side air system in the inkjet printer 1 are equal.

The positive-pressure-side air system indicates a portion to be pressurized by driving the air pump 65. Specifically, the positive-pressure-side air system includes the air layer 31 of the positive pressure tank 21 and portions that communicate with the air layer 31 with the positive-pressure-side air opening valve 53 closed. The air capacity of the positive-pressure-side air system is the sum of the capacities of the air layer 31 of the positive pressure tank 21 with the liquid level of ink at a reference height, the positive pressure common air chamber 51, the four positive-pressure-side communication pipes 52, the bellows 71 with the weight 72 at a reference position, the positive-pressure-side pressure regulation pipe 56, the portion between the positive pressure common air chamber 51 and the positive-pressure-side air opening valve 53 in the positive-pressure-side air opening pipe 54, and the portion between the positive pressure common air chamber 51 and the air pump 65 in the pipe 66 for air pump.

The negative-pressure-side air system indicates a portion to be pressurized by driving the air pump 65. Specifically, the negative-pressure-side air system includes the air layer 36 of the negative pressure tank 24 and portions that communicate with the air layer 36 with the negative-pressure-side air opening valve 60 closed. The air capacity of the negative-pressure-side air system is the sum of the capacities of the air layers 36 of the negative pressure tanks 24 with the liquid level of ink at a reference height, the negative pressure common air chamber 58, the four negative-pressure-side communication pipes 59, the bellows 76 with the weight 77 at a reference position, the negative-pressure-side pressure regulation pipe 63, the portion between the negative pressure common air chamber 58 and the negative-pressure-side air opening valve 60 in the negative-pressure-side air opening pipe 61, and the portion between the negative pressure common air chamber 58 and the air pump 65 in the pipe 66 for air pump.

Figure 4:
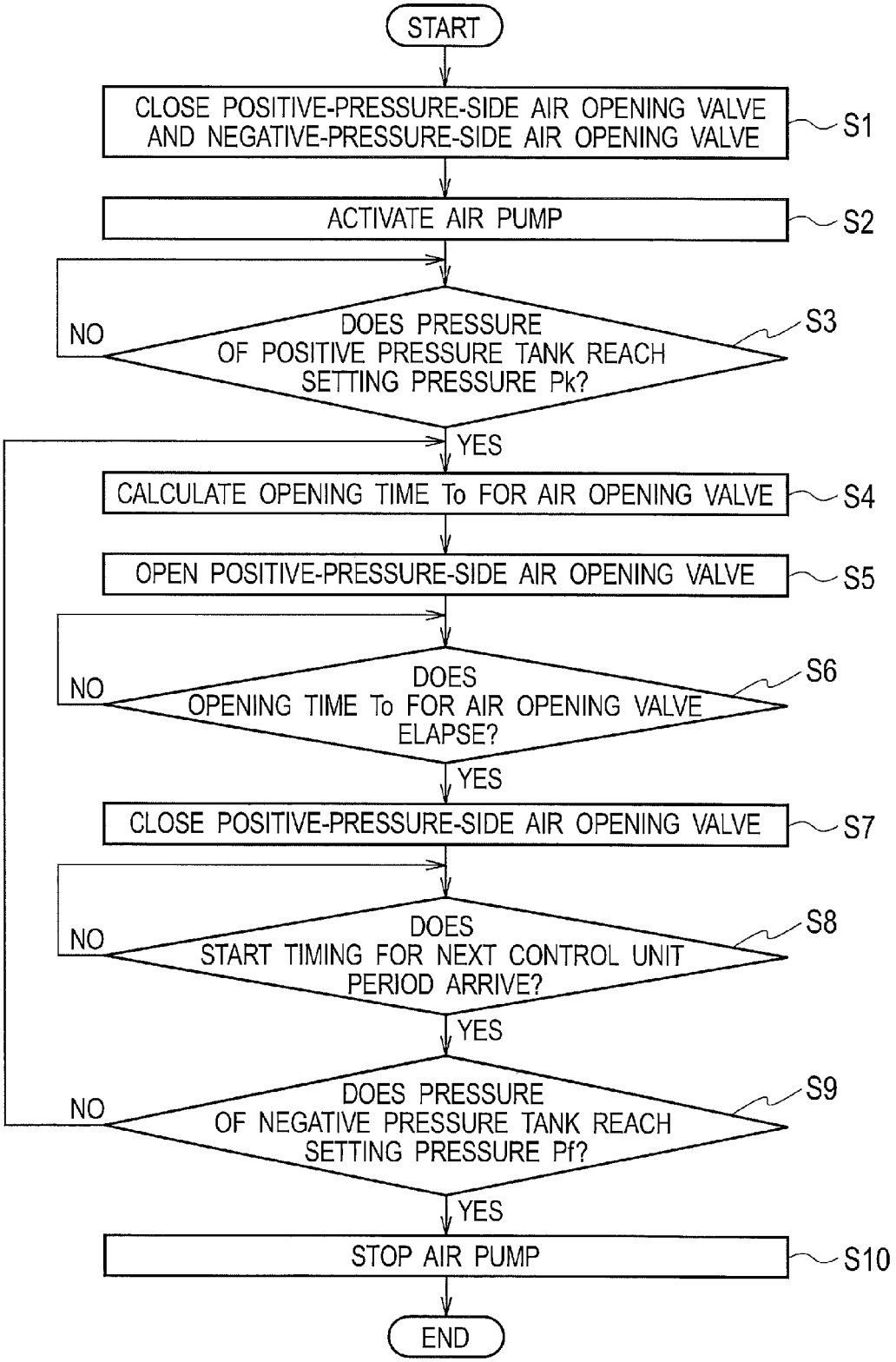
FIG. 4 is a flow chart of pressure generation processing.

FIG. 4 is a flow chart of pressure generation processing. The processing of the flow chart of FIG. 4 starts when a print job is inputted to the inkjet printer 1.

In step S1 of FIG. 4, the controller 5 closes the positive-pressure-side air opening valve 53 and the negative-pressure-side air opening valve 60. The closing of the positive-pressure-side air opening valve 53 sets the positive-pressure-side air system including the positive pressure tank 21 in a sealed state. The closing of the negative-pressure-side air opening valve 60 sets the negative-pressure-side air system including the negative pressure tank 24 in a closed state. It is to be noted that during standby in which ink is not circulated by the inkjet printer 1, the positive-pressure-side air opening valve 53 and the negative-pressure-side air opening valve 60 are open.

Subsequently, in step S2, the controller 5 activates the air pump 65. Thus, air is sucked from the negative pressure tank 24 and air is delivered to the positive pressure tank 21.

Subsequently, in step S3, the controller 5 determines whether or not the pressure of the positive pressure tank 21 reaches the setting pressure Pk, based on a value detected by the positive-pressure-side pressure sensor 57.

Figure 5:
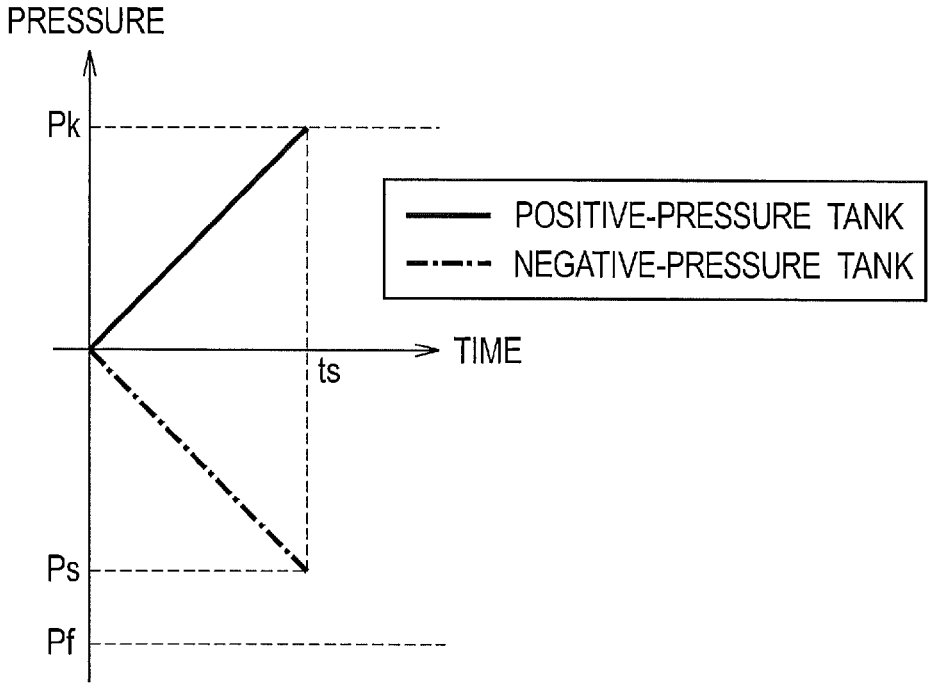
FIG. 5 is a graph illustrating a transition of the pressures of a positive pressure tank and a negative pressure tank after an air pump is activated.

Here, since the air capacities of the positive-pressure-side air system and the negative-pressure-side air system are equal as described above, after activation of the air pump 65, the negative pressure tank 24 is decompressed and the positive pressure tank 21 is pressurized in a state where the positive pressure of the positive pressure tank 21 and the negative pressure of the negative pressure tank 24 are equal in absolute value. As illustrated in FIG. 5, the pressure of the positive pressure tank 21 reaches the setting pressure Pk before the pressure of the negative pressure tank 24 reaches the setting pressure Pf. This is because the setting pressure Pf on the negative pressure side is higher in absolute value than the setting pressure Pk on the positive pressure side.

When it is determined that the pressure of the positive pressure tank 21 does not reach the setting pressure Pk (NO in step S3), the controller 5 repeats step S3.

When it is determined that pressure of the positive pressure tank 21 reaches the setting pressure Pk (YES in step S3), in step S4, the controller 5 calculates an air opening valve opening time To. The air opening valve opening time To is an opening time of the positive-pressure-side air opening valve 53 within a control unit period. The control unit period is a unit period for controlling the opening and closing of the positive-pressure-side air opening valve 53 after the pressure of the positive pressure tank 21 first reaches the setting pressure Pk. Time ts, at which the pressure of the positive pressure tank 21 first reaches the setting pressure Pk, is equivalent to the starting time of the first control unit period.

Specifically, the controller 5 obtains the pressure Ps of the negative pressure tank 24 at time ts from the negative-pressure-side pressure sensor 64, the time ts being the starting time of the control unit period. As illustrated in FIG. 5, the pressure Ps of the negative pressure tank 24 at time ts is higher than the setting pressure Pf (lower in absolute value than the setting pressure Pf).

Subsequently, the controller 5 calculates the difference in pressure between the positive pressure tank 21 and the negative pressure tank 24 at time ts as load pressure P of the air pump 65. That is, the controller 5 calculates the load pressure P of the air pump 65 by the following Expression (1).

$$P=Pf-Ps \tag{1}$$

Subsequently, the controller 5 calculates the flow rate Qp of the air pump 65 according to the calculated load pressure P, based on the PQ characteristic of the air pump 65.

Subsequently, the controller 5 calculates the air opening valve opening time To by the following Expression (2).

$$To=(Qp/Qo)\times Tp \tag{2}$$

where Qo is a theoretical value of the flow rate of air that flows out through the positive-pressure-side air opening pipe 54 when the positive-pressure-side air opening valve 53 is opened with the pressure of the positive-pressure-side air system at the setting pressure Pk. The flow rate Qo is a value that is determined by the design of the positive-pressure-side air system. Tp is a unit time and is the length of the control unit period.

The air opening valve opening time To is calculated by Expression (2) so that the amount of air that flows out through the positive-pressure-side air opening pipe 54 during the air opening valve opening time To is equal to the amount of air that is delivered by the air pump 65 during the unit time Tp.

Subsequently, in step S5, the controller 5 opens the positive-pressure-side air opening valve 53.

Subsequently, in step S6, the controller 5 determines whether or not the air opening valve opening time To elapses since the positive-pressure-side air opening valve 53 is opened in step S5. When it is determined that the air opening valve opening time To does not elapse (NO in step S6), the controller 5 repeats step S6.

When it is determined that the air opening valve opening time To elapses (YES in step S6), the controller 5 closes the positive-pressure-side air opening valve 53 in step S7.

Figure 6:
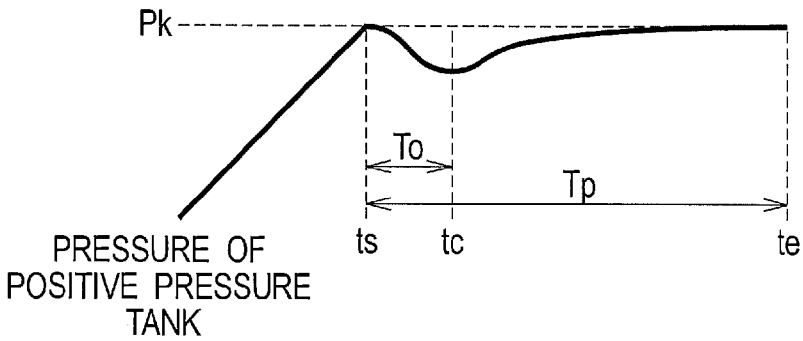
FIG. 6 is a graph illustrating the pressure of the positive pressure tank in a control unit period of the pressure generation processing.

When the positive-pressure-side air opening valve 53 is opened in step S5 described above, air flows through the positive-pressure-side air opening pipe 54, and thereby the pressure of the positive pressure tank 21 is decreased as illustrated in FIG. 6. Here, it is assumed that the time taken for processing of calculation of the air opening valve opening time To is extremely short and the positive-pressure-side air opening valve 53 is opened at time ts. Although the air pump 65 is driven while the positive-pressure-side air opening valve 53 is open, the pressure of the positive pressure tank 21 is decreased because the flow rate Qo supplied from the positive-pressure-side air opening pipe 54 is greater than the flow rate Qp supplied by the air pump 65.

When the positive-pressure-side air opening valve 53 is closed at time tc after elapse of the air opening valve opening time To since time ts, subsequently, the pressure of the positive pressure tank 21 is increased as illustrated in FIG. 6. At time te after the unit time Tp from time ts, the pressure of the positive pressure tank 21 returns to the setting pressure Pk. This is because the air opening valve opening time To is set so that the amount of air that flows out through the positive-pressure-side air opening pipe 54 during the air opening valve opening time To is equal to the amount of air that is delivered by the air pump 65 during the unit time Tp.

Returning to FIG. 4, in step S8 subsequent to step S7, the controller 5 determines whether or not start timing for the next control unit period arrives. Here, for instance, the start timing for the next control unit period subsequent to the first control unit period is the termination timing for the first control unit period, and corresponds to the time te of FIG. 6.

When it is determined that the start timing for the next control unit period arrives (YES in step S8), the controller 5 determines in step S9 whether or not the pressure of the negative pressure tank 24 reaches the setting pressure Pf, based on a value detected by the negative-pressure-side pressure sensor 64.

When it is determined that the pressure of the negative pressure tank 24 does not reach the setting pressure Pf (NO in step S9), the flow returns to step S4 and the controller 5 calculates the air opening valve opening time To for the next control unit period. The controller 5 then repeats the subsequent processing.

When it is determined that the pressure of the negative pressure tank 24 reaches the setting pressure Pf (YES in step S9), the controller 5 stops the air pump 65 in step S10. Thus, the pressure generation processing is terminated.

When the pressure generation processing is terminated, the respective setting pressures Pk, Pf are applied to the positive pressure tank 21 and the negative pressure tank 24 and ink is circulated along a circulation path, and the nozzle pressure of the inkjet head 11 achieves an appropriate negative pressure.

After the pressure generation processing, the controller 5 starts to execute a print job. Specifically, based on the print job, the controller 5 ejects ink from the inkjet head 11 onto a sheet of paper transferred by the transfer unit 4. Thus, an image is printed on the sheet of paper.

The controller 5 also performs liquid level maintaining control. The liquid level maintaining control is the control of the ink pump 25 and the ink supply valve 47 according to the liquid levels of the positive pressure tank 21 and the negative pressure tank 24 in order to maintain the liquid level at approximately the reference height.

Specifically, as illustrated in FIG. 7, in a state where both the positive pressure tank liquid level sensor 33 and the negative pressure tank liquid level sensor 38 indicate ON, the controller 5 turns off the ink pump 25 and closes the ink supply valve 47. Similarly, in a state where the positive pressure tank liquid level sensor 33 indicates ON and the negative pressure tank liquid level sensor 38 indicates OFF, the controller 5 turns off the ink pump 25 and closes the ink supply valve 47.

In a state where the positive pressure tank liquid level sensor 33 indicates OFF and the negative pressure tank liquid level sensor 38 indicates ON, the controller 5 turns on the ink pump 25 and closes the ink supply valve 47.

In a state where both the positive pressure tank liquid level sensor 33 and the negative pressure tank liquid level sensor 38 indicate OFF, the controller 5 turns off the ink pump 25 and opens the ink supply valve 47.

During execution of the print job, ink is supplied to the inkjet head 11 from the positive pressure tank 21, and the ink not consumed by the inkjet head 11 is collected into the negative pressure tank 24. When the positive pressure tank liquid level sensor 33 indicates OFF and the negative pressure tank liquid level sensor 38 indicates ON, the liquid level maintaining control causes the ink pump 25 to deliver ink from the negative pressure tank 24 to the positive pressure tank 21. When both the positive pressure tank liquid level sensor 33 and the negative pressure tank liquid level sensor 38 indicate OFF, the ink supply unit 13 supplies ink to the negative pressure tank 24. In this manner, the liquid levels of the positive pressure tank 21 and the negative pressure tank 24 are maintained, and printing is performed while ink is circulated.

Although the liquid levels of the positive pressure tank 21 and the negative pressure tank 24 are maintained by the above-described liquid level maintaining control, a certain degree of variation in liquid level occurs when ink flows in or flows out from the positive pressure tank 21 and the negative pressure tank 24 during ink circulation.

However, when the liquid level of the positive pressure tank 21 varies, the bellows 71 of the positive-pressure-side pressure regulator 55 expands or contracts accordingly, thereby maintaining the pressure of the positive pressure tank 21 at the setting pressure Pk. When the liquid level of the negative pressure tank 24 varies, the bellows 76 of the negative-pressure-side pressure regulator 62 expands or contracts accordingly, thereby maintaining the pressure of the negative pressure tank 24 at the setting pressure Pf. The weights 72, 77 of the positive-pressure-side pressure regulator 55 and the negative-pressure-side pressure regulator 62 are fixed to the respective reference positions until the pressure generation processing is terminated, and the fixed weights are released when the pressure generation processing is terminated.

During ink circulation, the controller 5 controls the ink temperature regulator 26 to regulate the ink temperature so that the temperature detected by the ink temperature sensor 27 is maintained in an appropriate temperature range.

When the print job is terminated, the controller 5 opens the positive-pressure-side air opening valve 53 and the negative-pressure-side air opening valve 60. Thus, the positive-pressure-side air system and the negative-pressure-side air system are opened to the atmosphere, and the ink circulation in the ink circulation unit 12 is terminated. Consequently, the operation of the inkjet printer 1 is terminated and the inkjet printer 1 is set in a standby state.

As described above, in the inkjet printer 1, the controller 5 closes the positive-pressure-side air opening valve 53 and the negative-pressure-side air opening valve 60, and drives the air pump 65 to generate the setting pressures Pk, Pf in the positive pressure tank 21 and the negative pressure tank 24 in the pressure generation processing. When the pressure of the positive pressure tank 21 reaches the setting pressure Pk after the activation of the air pump 65, the controller 5 calculates the air opening valve opening time To at each unit time Tp (control unit period), according to the difference in pressure between the positive pressure tank 21 and the negative pressure tank 24, and opens the positive-pressure-side air opening valve 53 for the air opening valve opening time To within the unit time Tp. The controller 5 performs the control until the pressure of the negative pressure tank 24 reaches the setting pressure Pf.

In this manner, control of opening and closing of the positive-pressure-side air opening valve 53 allows the pressure of the positive pressure tank 21 to be maintained at the setting pressure Pk when the pressure of the negative pressure tank 24 reaches the setting pressure Pf. For this reason, it is possible to generate the setting pressures Pk, Pf in the positive pressure tank 21 and the negative pressure tank 24 independent of the air capacities of the positive-pressure-side air system and the negative-pressure-side air system. Therefore, the air capacities of the positive-pressure-side air system and the negative-pressure-side air system do not have to be designed according to the respective setting pressures Pk, Pf.

Consequently, in the inkjet printer 1, it is possible to generate the setting pressures Pk, Pf in the positive pressure tank 21 and the negative pressure tank 24 by the single air pump 65 while avoiding reduction in flexibility of design of the air systems.

In the aforementioned embodiment, the case has been described in which the pressure of the positive pressure tank 21 reaches a corresponding setting pressure before the pressure of the negative pressure tank 24 reaches a corresponding setting pressure. However, depending on the relationship between the air capacities of the positive-pressure-side air system and the negative-pressure-side air system, the pressure of the negative pressure tank 24 may reach a corresponding setting pressure before the pressure of the positive pressure tank 21 reaches a corresponding setting pressure. The present disclosure is also applicable to such a case. In the pressure generation processing, it is sufficient to control opening and closing of an air opening valve (the positive-pressure-side air opening valve 53 or the negative-pressure-side air opening valve 60) for one of the positive pressure tank 21 and the negative pressure tank 24 in which the pressure reaches the setting pressure first.

In the aforementioned embodiment, a configuration has been described in which the air pump 65 indirectly sucks air from the negative pressure tank 24 and delivers air to the positive pressure tank 21 through the negative pressure common air chamber 58 and the positive pressure common air chamber 51. However, a configuration may be adopted in which the pipe for air pump is connected to the positive pressure tank and the negative pressure tank and the air pump 65 directly sucks air from the negative pressure tank and delivers air to the positive pressure tank.

Embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. An inkjet printer comprising:

an inkjet head with a nozzle for ejecting ink;

a positive pressure tank configured to store the ink to be supplied to the inkjet head;

a positive-pressure-side air opening valve configured to switch between a sealed state and an air open state of the positive pressure tank;

a negative pressure tank configured to receive the ink not consumed by the inkjet head;

a negative-pressure-side air opening valve configured to switch between a sealed state and an air open state of the negative pressure tank;

a circulation path for circulating the ink among the positive pressure tank, the inkjet head, and the negative pressure tank;

a single air pump configured to draw in air from the negative pressure tank and to deliver the drawn in air to the positive pressure tank; and a controller configured to drive the positive-pressure-side air opening valve and the negative-pressure-side air opening valve to switch to and hold the sealed states of the positive pressure tank and the negative pressure tank and then drive the single air pump to generate a first setting pressure in the positive pressure tank and a second setting pressure in the negative pressure tank, upon starting circulation of the ink in the circulation path, wherein, when the controller drives the single air pump and upon a pressure of the positive pressure tank reaching the first setting pressure prior to a pressure of the negative pressure tank reaching the second setting pressure, the controller is configured to:

set a first air opening valve opening time at each unit time according to a difference between the pressure of the positive pressure tank and the pressure of the negative pressure tank; and repeatedly drive of the positive-pressure-side air opening valve to switch to and hold the air open state of the positive pressure tank for the set first air opening valve opening time within the unit time, until the pressure of the negative pressure tank reaches the second setting pressure, as the controller continues to drive the single air pump, and when the controller drives the single air pump and upon a pressure of the negative pressure tank reaching the second setting pressure prior to a pressure of the positive pressure tank reaching the first setting pressure, the controller is configured to:

set a second air opening valve opening time at each unit time according to a difference between the pressure of the positive pressure tank and the pressure of the negative pressure tank; and repeatedly drive the negative-pressure-side air opening valve to switch to and hold the air open state of the negative pressure tank for the set second air opening valve opening time within the unit time, until the pressure of the positive pressure tank reaches the first setting pressure, as the controller continues to drive the single air pump.

2. The inkjet printer according to claim 1, wherein the single air pump comprises:

an inlet in fluid communication with the negative pressure tank via the circulation path; and an outlet in fluid communication with the positive pressure tank via the circulation path.

3. The inkjet printer according to claim 1, wherein the controller, upon setting the first air opening valve opening time, determines the first air opening valve opening time such that an amount of air flowing out of the positive pressure tank due to the air open state of the positive pressure tank held by the positive-pressure-side air opening valve for the set first air opening valve opening time equals an amount of air delivered into the positive pressure tank for the unit time by the single air pump, and the controller, upon setting the second air opening valve opening time, determines the second air opening valve opening time such that an amount of air flowing into the negative pressure tank due to the air opening state of the negative pressure tank held by the negative-pressure-side air opening valve for the set second air opening valve opening time equals an amount of air drawn in from the negative pressure tank for the unit time by the single air pump.

* * * * *